US006637232B1

(12) United States Patent
Harshberger et al.

(10) Patent No.: US 6,637,232 B1
(45) Date of Patent: Oct. 28, 2003

(54) UNIT VENTILATOR

(75) Inventors: Martin J. Harshberger, Germantown, TN (US); Steven G. Hicks, Cordova, TN (US); Timothy D. Welch, Grand Junction, TN (US)

(73) Assignee: .PEF Industries, Inc., Somerville, TN (US)

( * ) Notice: Subject to any disclaimer, the term of this patent is extended or adjusted under 35 U.S.C. 154(b) by 0 days.

(21) Appl. No.: 10/201,647

(22) Filed: Jul. 24, 2002

(51) Int. Cl.[7] ..... F25D 21/14

(52) U.S. Cl. ..... 62/285; 62/262; 165/48.1; 165/59; 165/122

(58) Field of Search ..... 62/285, 429, 515, 62/262, 259.1, 426; 165/48.1, 59, 122

(56) References Cited

U.S. PATENT DOCUMENTS

| | | | | | |
|---|---|---|---|---|---|
| 3,012,762 | A | | 12/1961 | Norris | |
| 3,165,625 | A | | 1/1965 | Potter | |
| 3,262,491 | A | * | 7/1966 | Shelhost | 165/48.1 |
| 3,326,276 | A | | 6/1967 | Wilhoite | |
| 3,411,569 | A | | 11/1968 | Hildreth | |
| 3,666,007 | A | | 5/1972 | Yoshino et al. | |
| 3,741,290 | A | | 6/1973 | Nenadal | |
| 3,874,191 | A | | 4/1975 | Hudson | |
| 4,333,520 | A | | 6/1982 | Yanadori et al. | |
| 4,449,579 | A | * | 5/1984 | Miyazaki et al. | 164/104.33 |
| 4,474,232 | A | | 10/1984 | Wright et al. | |
| 4,492,094 | A | | 1/1985 | Katayama | |
| 4,835,983 | A | | 6/1989 | Chandler, Jr. et al. | |
| 4,885,916 | A | * | 12/1989 | Arndt | 62/244 |
| 4,951,737 | A | | 8/1990 | Tenhundfeld et al. | |
| 5,035,281 | A | | 7/1991 | Neuenfeldt et al. | |
| 5,152,336 | A | | 10/1992 | Wollaber et al. | |
| 5,203,400 | A | * | 4/1993 | Tsunekawa et al. | 165/59 |
| 5,301,744 | A | | 4/1994 | Derks | |
| 5,664,995 | A | * | 9/1997 | O'Keefe | 454/58 |
| 5,924,300 | A | | 7/1999 | Fromm et al. | |
| 6,206,085 | B1 | | 3/2001 | Correa | |
| 6,318,104 | B1 | * | 11/2001 | Moraes et al. | 62/262 |

FOREIGN PATENT DOCUMENTS

| | | | | |
|---|---|---|---|---|
| WO | WO 99/67580 | * | 12/1999 | F25F/13/20 |

* cited by examiner

*Primary Examiner*—William E. Tapolcai
*Assistant Examiner*—Mohammad M. Ali
(74) *Attorney, Agent, or Firm*—Armstrong, Westerman & Hattori, LLP

(57) ABSTRACT

A unit ventilator is disclosed wherein, in order to facilitate service and repair of the ventilator and/or its component parts, such parts are mounted for ease of access and of detachment from, or assembly to, the system. Elemental system parts, such as the blower assembly, the heat transfer coil assembly, the condensate discharge pan and the air filters are designed and arranged so as to be assembled and/or disassembled from the system rapidly and with minimum use of tools.

12 Claims, 3 Drawing Sheets

UNIT VENTILATOR

The present invention relates to unit ventilators having a blower or fan and being operative for discharging either cooled or heated air into a space to be ventilated. More particularly, the present invention concerns a unit ventilator system wherein, due to element design and system arrangement, components are readily removable and installable in order to facilitate replacement or service of the components and to reduce to a minimum the time, effort and cost attendant with system service and maintenance.

BACKGROUND OF THE DISCLOSURE

Unit ventilators are commonly used for ventilating school classrooms or other spaces which are subject to high density occupancy. While a usual function of equipment of the concerned type is to provide ventilation cooling from the introduction outside air into the space to be cooled, means may be provided whereby the air admitted through the ventilation apparatus can be mechanically cooled or, alternatively, heated. Moreover, the air may be totally or proportionately recirculated within the ventilated space. Thus, such unit ventilators will normally comprise a cabinet enclosure in which the component ventilator parts include a motor-driven fan or blower, a heat transfer coil, appropriate air flow filters and dampers for directing and conducting air flow through the apparatus.

Because unit ventilators heretofore known in the art consist essentially of cabinets, or the like, in which the apparatus components are housed within a confined space, it has been the practice to fixedly mount the respective component parts to framing structure within the cabinet. While such apparatus of heretofore known design and construction may function acceptably, a problem occurs when it is necessary to service and repair or replace one or more of the apparatus components. This problem results from the need for disassembly from the cabinet framing structure of the respective elements of the ventilator apparatus in order, first, to obtain access to an affected component and, secondly, to remove an affected component from the apparatus for maintenance or replacement purposes. The result, therefore, is that much time and effort is normally required for servicing such ventilating apparatus thereby resulting in higher than desired costs for equipment service and longer than desirable downtime of the ventilating apparatus.

SUMMARY OF THE INVENTION

It is to the amelioration of the above problems to which the present invention is directed. Accordingly, it is an object of the invention to provide a unit ventilator that can be easily and rapidly serviced.

It is also an object of the invention to provide a unit ventilator that has modular components, which can be readily removed from, or installed in, the apparatus thereby facilitating easy access to apparatus components for servicing.

It is a further object of the invention to provide a unit ventilator wherein access to the component elements thereof is readily available upon removal of only the front panel of the cabinet, whereby maintenance and servicing of the apparatus can be performed from within the room or space being ventilated.

It is still another object of the invention to provide a unit ventilator wherein the removal of components, such as the motorboard assembly or the heat transfer coil, can be made without affecting the integrity of the unit ventilator chassis.

It is yet another object of the invention to provide a unit ventilator of the described type having the capability of effectively processing and circulating fresh outside air and return air to a room in regulated amounts.

These and other objects and advantages are provided by the hereinafter described unit ventilator which includes a cabinet forming a fixed enclosure and having openings forming an inlet for input air and an outlet for discharge air spaced from the inlet. Framing structure for the cabinet includes a top plate, a base plate, a pair of oppositely spaced end plates upstanding from the base, and a readily removable front panel. A fan assembly including a motorboard, at least one fan and drive means therefor is suspended from the motorboard, the assembly being easily accessible and removable from the apparatus. Also provided is a coil assembly including a plurality of finned coil tubes, a pair of tube sheets at oppositely spaced ends of the coil tubes and operative to connect the coil tubes for circulation of a heat transfer fluid therethrough. Flange means provided on the framing structure end plates include a first set of flanges operative to mountingly receive cooperating flanges on the coil assembly for detachably supporting the coil assembly on the end plates. A second set of flanges are also provided on the end plates in order to mountingly receive the motorboard for also detachably supporting the fan assembly on the end plates. Adjustable damper means for circulating input air consisting of regulated amounts of either outside air or room return air through the fan assembly and, thence, in heat transfer relation with respect to the coil tubes before discharge from the ventilator outlet.

For a better understanding of the invention, its operating advantages and the specific objectives obtained by its use, reference should be made to the accompanying drawings and description which relate to a preferred embodiment thereof.

DESCRIPTION OF A PREFERRED EMBODIMENT OF THE INVENTION

Figure 1:
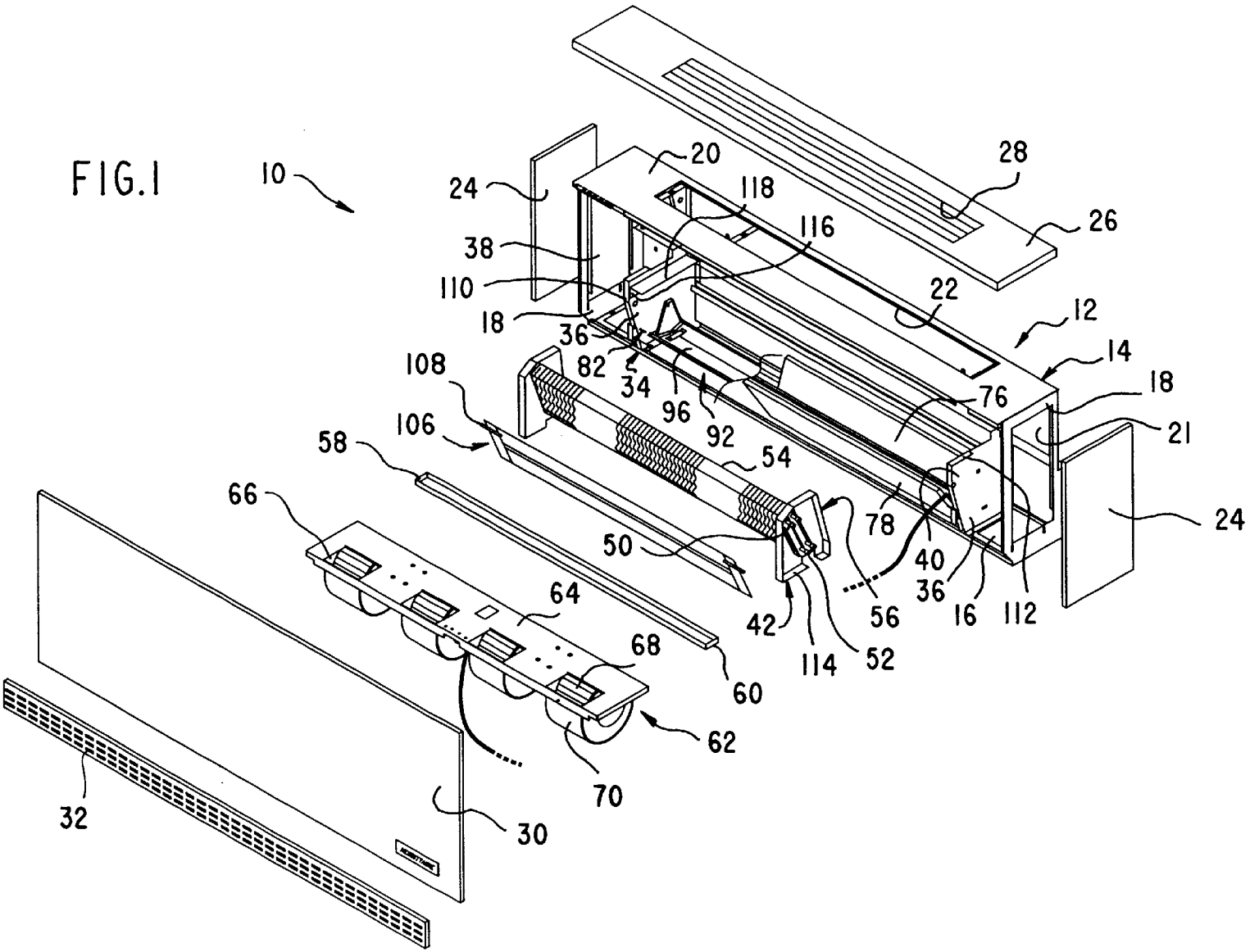
FIG. 1 is an exploded perspective view of a unit ventilator according to the present invention.

With particular reference to the drawings wherein like reference numerals designate like parts throughout the respective views, there is shown an exploded representation of a unit ventilator 10 according to the present invention. It includes a main chassis 12 providing a primary frame 14 which includes an elongated base 16, end plates 18 upstanding from opposite ends of the base, and a top plate 20 containing an air discharge opening 22 extending between, and joining, the upper ends of the end plates. Panels including end panels 24 and top panel 26 cover the end and top plates of the frame structure to form a cabinet of generally rectangular polyhedronal shape, with the top panel 26 containing a louvered opening 28 that overlies and communicates with the opening 22 in top plate 20 to form an air discharge opening from which processed air is discharged into the ventilated space. Front panel 30 is adapted by appropriate fastenings (not shown) for easy assembly to, and removal from, the front side of the primary frame of the main chassis 12 whereby easy access to the ventilator interior is obtained. The front panel 30 is provided along its bottom edge with an angularly offset return air grill 32 having openings defining a return air inlet to the apparatus, as hereinafter more fully described.

Included as part of the frame structure of the ventilator 10 is a secondary frame 34 that includes oppositely spaced end walls 36 which are upstanding from the base 16 and which extend substantially across the depth of the frame structure. As shown in FIG. 1, the end walls 36 of the secondary frame 34 are each spaced laterally inwardly from the end plates 18 of the primary frame structure 14 in order to define compartments 38 and 40 at opposite ends of the cabinet that conveniently provide spaces for the placement of controls, motors, and other ancillary equipment for operation of the apparatus.

Figure 2:
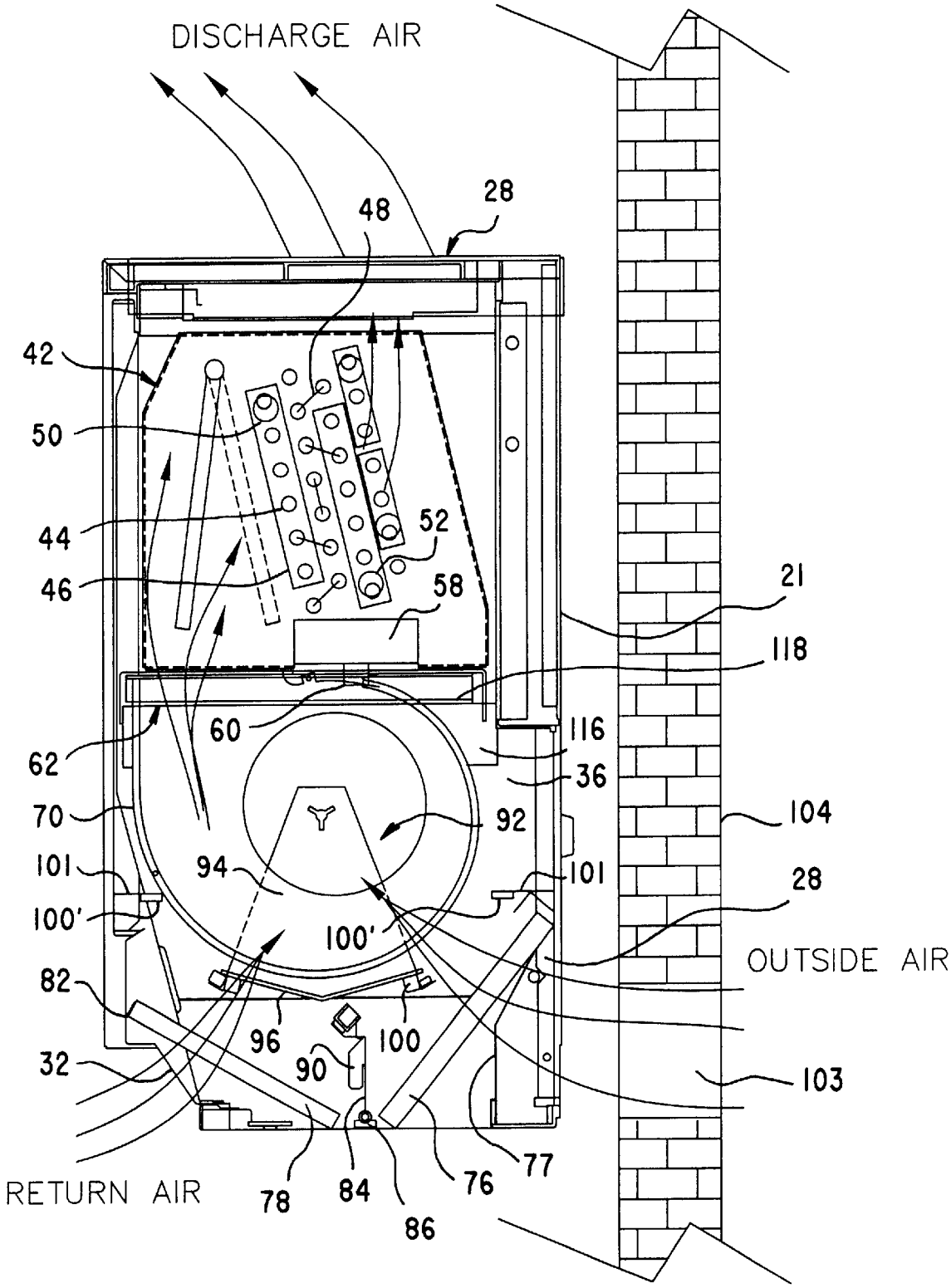
FIG. 2 is an essentially schematic side elevational view of the unit ventilator shown in FIG. 1.

Within the chassis 12, for air processing purposes is a heat transfer coil 42 that comprises a plurality of small diameter tubes 44 which connect at opposite ends with tube sheets 46. As shown in FIG. 2, the ends of selected tubes 44 are connected by return bends 48 which enable circulation of heat transfer fluid through the tubes between an inlet 50 and an outlet 52 that are adapted, by appropriate piping (not shown) to connect with a source of heat transfer fluid which may be, for cooling purposes, either cool water or refrigerant or, for heating purposes, either hot water or steam. Extended heating surface in the form of fins 54 that extend transversely across the tubes 44 enhances the transfer of heat between the process air, which flows across the coil, and heat transfer fluid which passes through the tubes.

The invention contemplates use of a single heat transfer coil 42 whose inlet and outlet may connect alternatively either to a source of cooling fluid or to a source of heating fluid. In such arrangement the heat transfer coil 42 for cooling purposes could be physically removed and replaced by a heat transfer coil for heating purposes. The heat transfer coil assembly 42 shown in FIG. 2 contemplates, however, yet another arrangement wherein multiple tube sheets 46, which are indicated as 46 and 46' in the drawings, are used and wherein the tube sheet 46 connects tubes 44 with a source of cooling fluid and the tube sheet 46' connects tubes 44 with a source of heating fluid, and wherein the respective coils are rendered operable in one mode or the other by appropriate flow control equipment. Consequently, the heat transfer coil can be conveniently provided as a cooling device, a heating device or a combination heating and cooling device, by merely changing only the heat transfer coil subassembly.

With particular reference to FIG. 1, it is shown that vertical support for the heat transfer coil or coils 42 is provided by flanged footing supports 56 which each contain aligned recesses 57 at their bottom ends in order to accommodate a condensate drain pan 58 that extends beneath the heat transfer coil 42 substantially coexistensively therewith and that operates to collect condensate discharged from the surfaces of the coil tubes. The drain pan 58 is preferably pitched toward one end where a discharge pipe 60 can be connected to a point of discharge for removal of condensate resulting from operation of the heat transfer coil.

Figure 3:
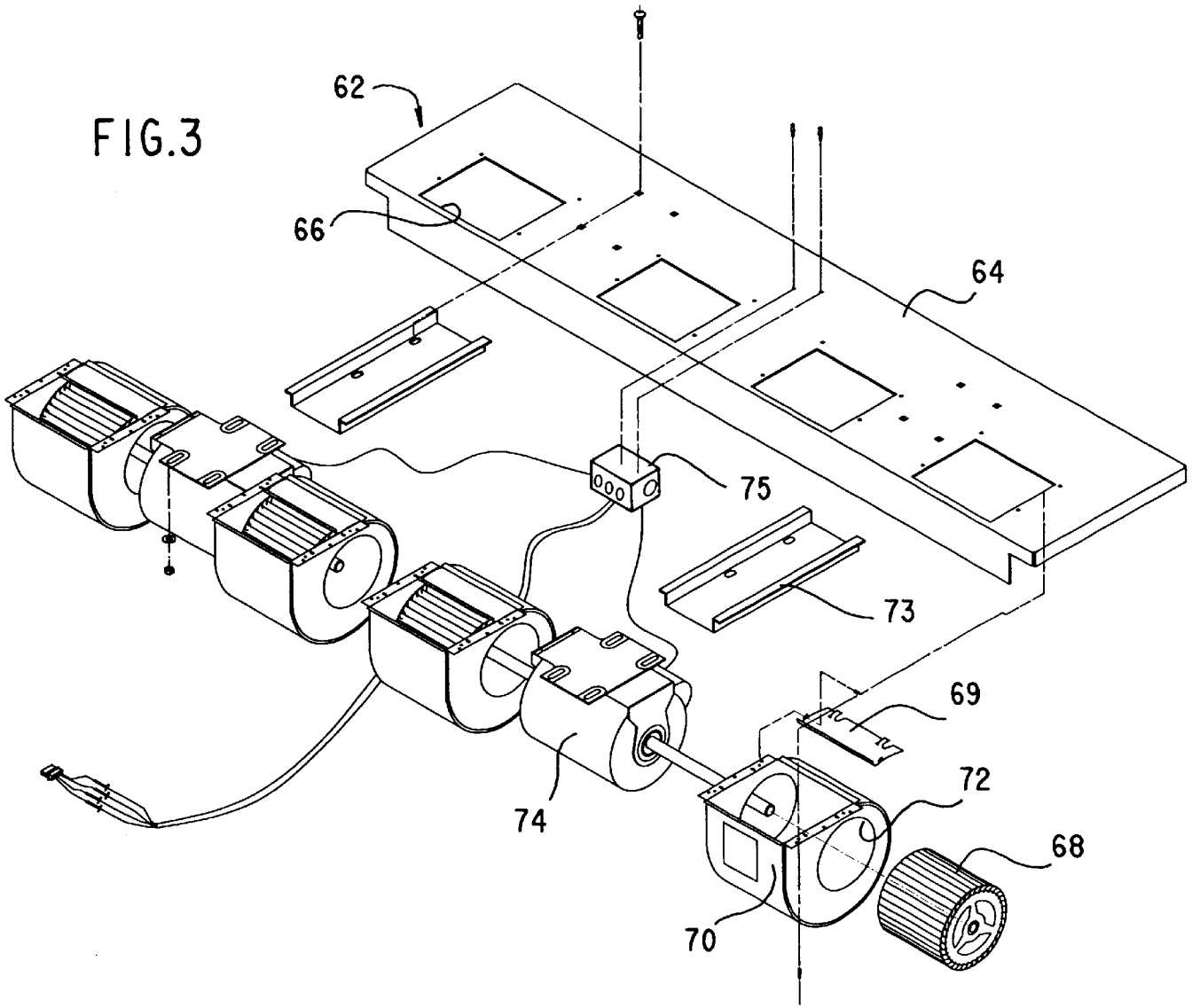
FIG. 3 is an exploded perspective view of a blower and motorboard assembly which can be used in the unit ventilator of FIG. 1.

The unit ventilator 10 utilizes a motorboard assembly 62 for the circulation of process air from one or the other, or both, of the air inlets formed by the outside air inlet defined by the louvered opening 28 on the back wall of the apparatus 10 or by the return air inlet defined by the return air grill 32 provided on the front panel 30. The motorboard assembly 62 comprises, as best shown in FIG. 3, a motorboard 64 in the form of an elongated plate having longitudinally spaced openings 66 which each provide a discharge outlet for one of a plurality of cylindrical blowers 68. Each blower 68 is covered by a cover 70, which is preferably of involute shape that contains axially aligned openings 72 forming air inlets to the blower. As installed, the motorboard assembly 62 fixedly mounts an electric drive motor 74 having drive shafts 76 that extend in opposite directions for connection with longitudinally spaced blowers 68 between which the motor is placed. In the preferred embodiment, the motorboard assembly 62 includes a pair of drive motors 74, each being interposed between a pair of blowers 68. It will be appreciated, however, that the number of drive motors 74 employed, and the number of blowers 68 attached to each, is arbitrary and can be increased or decreased depending on the blower capacity desired for the apparatus. Spacer brackets 73 are disposed between the motorboard 64 and the respective drive motors 74 being secured therebetween by fastenings that secure the drive motors to the motorboard. Also, each cover 70 contains a removable section 69 to facilitate removal of the blowers 68. A motor control unit 75 is adapted for mounting in one of the compartments 38 or 40 and connects the respective motors to a source of electrical power.

The process air which enters the apparatus is filtered by readily removable sheet filters 76 and 78, with an outside air filter 76 being caused to simply extend inclinedly between the frame base 16 and the underside of an elongated rail 80 that extends between the secondary frame end walls 36, and wherein the return air filter 78 is inclinedly supported by the frame base 16 and a pair of pins 82 that protrude in opposite directions from the secondary frame end walls 36.

A partition plate 84 is disposed between the respective filters 76 and 78, and is upstanding from the frame base 16. The principle function of the partition plate 84 is to separate an outside air flow path from a return air flow path. The partition plate 84 is pivotedly mounted to the frame base 16 by means of a pin connection 86 in order to permit it to pivot forwardly when a wing grip 90 thereon is grasped. This enables the partition plate 84 to fold with respect to the frame base whereby access to the outside air filter 76, as hereafter more fully explained, is obtained.

Control of flow of inlet air to the apparatus is provided by a roll damper assembly 92 that is attached to the secondary frame end wall 36 for pivotal movement and is operative to regulate the source of inlet air to be processed from a full outside air flow to a full return air flow or with proportionate amounts of each. As shown, the roll damper assembly 92 includes a pair of end brackets 94 (only one of which is shown in the drawings) which are suspended by means of pivot pins from the respective secondary frame end walls 36. A damper plate 96, here shown as being of chevron or V-shape, is carried between the respective end brackets 94 and extends substantially the full length of the space within the secondary frame 34 between the end walls 36. The damper plate 96 is positioned with respect to the louvered opening 28 on the back of the secondary frame 34 and the return air grill 32 on the front panel 30 to regulate air flow input to the ventilator proportionately between outside air and return air. The position of the damper plate 96 is effected by means of a proportioning motor (not shown), the drive shaft of which connects with one end bracket 94 or the other of the roll damper.

As shown in FIG. 2, edges of the damper plate 96 are provided along their lengths with seal strips 100 made of soft resilient material, such as soft neoprene. The seal strips 100 cooperate with corresponding strips 100', one being disposed on the partition plate 84 and the other being disposed on a bracket 101 attached to appropriate walls, in order to seal the interface between the edges of the damper plate with the respective cooperating elements.

In operation, the unit ventilator 10 is typically installed in a room or space to be ventilated with the back plate 21 disposed closely adjacent the inside wall thereof and the louvered opening 28 communicating with a duct or other conductor (not shown) for supplying outside air through an opening 103 in a building wall 104, or the like. When a demand for room ventilation occurs, operation of the blowers 68 is initiated in order to induce a flow of inlet air into the unit ventilator for ultimate discharge through the air discharge opening 22 in the top plate 20 of the main chassis 12 and air discharge opening 28 in the top panel 26. Depending upon the comfort requirement to be served, the inlet air into the unit ventilator 10 will be supplied, as outside air entering the ventilator through the louvered opening 28 from outside the building, or the inlet air can be return air, which enters the ventilator through the return air grill 32. Alternatively, the inlet air may be proportioned amounts of both outside and return air, which amounts will be determined by the selected position of the roll damper assembly 92. It will be appreciated that all of the air that enters the ventilator is caused to pass through one or both of the outside air filter 76 and the return air filter 78 whereby particulate impurities can be removed from the inlet air prior to processing.

Air flowing from the discharge openings 66 in the motorboard 64 flows along a flow path indicated by solid arrows in FIG. 2 through the heat transfer coil 42 wherein, depending upon whether the coil is connected to a source of either low temperature heat transfer fluid, such as cool water or liquid refrigerant, or high temperature heat transfer fluid, such as hot water or steam, the temperature of the ventilation air flowing between the fins 54 across the coil tubes 44 is either lowered or raised before passing from the air discharge opening 22 provided in the main chassis top panel 26. (It should be appreciated that in the coil assembly 42 shown in FIG. 2, the heat transfer coil assembly comprises both a coil arrangement, indicated as $\mathbf{42}_a$, contemplated for connection to a low temperature heat transfer fluid source for cooling the ventilation air, and a coil arrangement, indicated as 42*b*, contemplated for connection to a high temperature heat transfer fluid source for heating the ventilation air. Alternatively, the heat transfer coil assembly 42 may be made to accommodate only a single heat transfer coil assembly, which would be replaced by an alternate coil assembly depending upon whether cooling or heating of the ventilation air is desired.)

A bypass damper 106 is preferably mounted between secondary frame end walls 36 for pivotal movement by means of pins 108 which are received in holes 110 provided in the end walls. One of the pins 108 is adapted to connect with a driving motor (not shown) that is operative to move the plate angularly with respect to the inlet side of the heat transfer coil. In this way, inlet air to the unit ventilator 10 can flow directly between either or both the outside air inlet defined by the louvered opening 28 and/or the return air opening defined by the grill 32 to the air discharge opening 22 in the top panel 26 for delivery to the space to be ventilated.

Major advantages from use of the present invention derive from the fact that, due to design and structural characteristics of the component elements, the servicing and replacement of such elements are greatly facilitated as compared with elements of corresponding equipment of the prior art. For example, the secondary frame end walls 36 of the described apparatus are provided with substantially horizontally disposed, outwardly offset flanges 112 which are adapted to slidingly receive the cooperating bottom flanges 114 of the footing support 56 of the heat transfer coil 42. Similarly, the secondary end walls 36 each have attached thereto, as by means of welding, brackets 116 having oppositely facing inturned flanges 118 which are each adapted to slidingly receive an end of the motorboard 64 of the motorboard assembly 62.

Furthermore, due to the structural cooperation between recess 120 formed on the lower ends of the respective end walls and the motorboard 64, the drain pan 58 can be installed without fastenings. Also, installed without fastenings are the outside air and return air filters 76 and 78 which simply have their upper ends resting on elevated supports which, in the case of the outside air filter 76 may be an elongated angle member 77 that extends between end walls 36 to stiffen the secondary frame 34. The return air filter 78, on the other hand, has its upper end restingly received on pins 82.

As a result of the hereindescribed invention, there is provided a unit ventilator which can be serviced in only a fraction of the time as is required by comparable ventilators of the prior art. A service worker need only remove the front panel 30 to expose the internal ventilator components, most of which, including the heat transfer coil assembly 42 and condensate draining pan, the motorboard assembly, the return and outside air filters, can be disassembled and thereafter reassembled with minimal or no use of tools whereby the downtime required for performing maintenance or service on a unit ventilator is reduced to a mere fraction of that previously required.

Moreover, the present invention provides the distinct advantage that changes in system capability can be made, i.e., from cooling to heating or from cooling to cooling and heating, subsequent to initial unit ventilator installation without significant equipment alteration, other than replacement of the heat transfer coil subassembly.

It will be understood that various changes in the duties, materials and arrangement of parts which have been herein described and illustrated in order to explain the mature of the invention, may be made by those skilled in the art within the principal and scope of the invention as expressed in the appended claims.

What is claimed is:

1. A unit ventilator comprising:

a cabinet forming a fixed enclosure and having openings forming an inlet for input air and an outlet for discharge air spaced from said inlet;

framing structure for the cabinet including a top plate, a base plate, a pair of oppositely spaced end plates upstanding from said base, and a removable front panel;

a fan assembly including a motorboard having at least one fan and drive means therefore suspended from said motorboard;

a coil assembly including a plurality of coil tubes, a pair of tube sheets at oppositely spaced ends of said coil tubes and being operative to connect said coil tubes for circulation of a heat transfer fluid therethrough;

flange means disposed on said end plates including a first set of flanges operative to mountingly receive cooperating flanges on said coil assembly for detachably supporting said coil assembly on said end plates, and a second set of flanges on said end plates to mountingly receive said motor board for detachably supporting said fan assembly on said end plates; and means for circulating input air through said fan assembly and, thence, in heat transfer relation with respect to said coil tubes before discharge from said outlet.

2. The ventilator according to claim 1, in which said inlet includes mutually spaced openings including an opening for receiving outside air and an opening for receiving return air, and a roll damper pivotally mounted between said end plates for determining the flow of input air for circulation through said fan assembly.

3. The unit ventilator according to claim 2, wherein said opening for receiving outside air and said opening for receiving return air are mutually oppositely spaced from each other; means forming filter plates disposed adjacent each of the respective openings; and a partition plate interposed between said filters and cooperable with said roll damper for directing the flow of input air through said cabinet.

4. The unit ventilator according to claim 3, wherein said partition plate is upstanding from said base; and means for pivotally mounting said partition plate whereby said partition plate can be moved to permit access to both said return air filter and said outside air filter when said front panel is removed.

5. The unit ventilator according to claim 1, wherein footing flanges on said coil assembly cooperate with flanges disposed at the upper ends of said end plates for mounting said coil assembly between said end plates.

6. The unit ventilator according to claim 5, including an elongated drain pan for receiving condensate from said coil tubes, said drain pan extending between, and being supported at its ends by, said end plates; and recess means on said footing supports for restricting the position of said drain pan beneath said coil tubes.

7. A unit ventilator comprising:

a cabinet forming a fixed enclosure and having openings forming an inlet for input air and an outlet for discharge air spaced from said inlet;

framing structure for the cabinet including a top plate, a base plate, a pair of oppositely spaced end plates upstanding from said base plate, and a removable front panel, said end plates each being spaced inwardly from respective ends of said cabinet;

a fan assembly including a motorboard, at least one fan and drive means therefor suspended from said motorboard;

a coil assembly including a plurality of coil tubes, a pair of tube sheets at oppositely spaced ends of said coil tubes and being operative to connect said coil tubes for circulation of a heat transfer fluid therethrough;

flange means disposed on said end plates including a first set of flanges containing flanges being offset from an upper edge of said end plates and operative to mountingly receive cooperating flanges on said coil assembly for detachably supporting said coil assembly on said end plates, and a second set of flanges on said end plates containing flanges spaced below said first set of flanges and being offset from said end plates intermediate the height thereof to mountingly receive said motor board for detachably supporting said fan assembly on said end plates; and means for circulating input air through said fan assembly and, thence, in heat transfer relation with respect to said coil tubes before discharge from said outlet.

8. The unit ventilator according to claim 7, in which said inlet includes mutually spaced openings including an opening for receiving outside air and an opening for receiving return air, and a roll damper pivotally mounted between said end plates for determining the flow of input air for circulation through said fan assembly.

9. The unit ventilator according to claim 8, wherein said opening for receiving outside air and said opening for receiving return air are mutually oppositely spaced from each other; means forming filter plates disposed adjacent each of the respective openings; and a partition plate interposed between said filters and cooperable with said roll damper for directing the flow of input air through said cabinet.

10. The unit ventilator according to claim 9, wherein said partition plate is upstanding from said base; and means for pivotally mounting said partition plate whereby said partition plate can be moved to permit access to both said return air filter and said outside air filter when said front panel is removed.

11. The unit ventilator according to claim 7, wherein footing flanges on said coil assembly cooperate with flanges disposed at the upper ends of said end plates for mounting said coil assembly between said end plates.

12. The unit ventilator according to claim 11, including an elongated drain pan for receiving condensate from said coil tubes, said drain pan extending between, and being supported at its ends by, said end plates; and recess means on said footing supports for restricting the position of said drain pan beneath said coil tubes.

* * * * *